US006349469B1

(12) United States Patent
Larson

(10) Patent No.: US 6,349,469 B1
(45) Date of Patent: Feb. 26, 2002

(54) METHOD OF ALIGNING A FREELY CARRYING BEARING ASSEMBLY ON A CYLINDER IN A FIBER-MAKING MACHINE

(75) Inventor: Kenneth H. Larson, Appleton, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/324,396

(22) Filed: Jun. 3, 1999

(51) Int. Cl.[7] ..... B21D 53/10
(52) U.S. Cl. ..... 29/898.07; 29/407.05
(58) Field of Search ..... 29/898.07, 898.09, 29/898.062, 407.05, 407.01, 407.04

(56) References Cited

U.S. PATENT DOCUMENTS

| | | | | | |
|---|---|---|---|---|---|
| 5,125,156 | A | * | 6/1992 | Witte | 29/898.09 |
| 5,165,169 | A | * | 11/1992 | Boyce | 29/898.08 |
| 5,333,380 | A | * | 8/1994 | Patz et al. | 29/898.07 |
| 5,399,025 | A | * | 3/1995 | Higuchi et al. | 384/428 |
| 5,442,854 | A | * | 8/1995 | Koltookian et al. | 29/898.07 |

OTHER PUBLICATIONS

"The CARB bearing—a better solution for the front side of drying cylinders", SKF, 1997, Publication 4410/I E.

* cited by examiner

*Primary Examiner*—S. Thomas Hughes
*Assistant Examiner*—Marc W Butler
(74) *Attorney, Agent, or Firm*—Taylor & Aust, P.C.

(57) ABSTRACT

The invention is directed to a method of aligning a bearing assembly relative to a roll in a fiber-making machine. The method of the present invention is particularly adapted for dryer cylinders in a paper-making machine, the dryer cylinders having an end rotatably mounted in a preferably freely carrying bearing assembly such as a continuous aligning roller bearing (CARB) that allows for axial (z direction) movement of the cylinder particularly axial movement due to thermal expansion. The bearing assembly includes inner and outer races of which the outer race is stationary with the inner race is affixed to the journal and moves therewith. For axially aligning or providing an initial offset of the outer race to the inner race, an alignment plate is mounted to the end of the cylinder journal during bearing housing installation that allows various measurements to be taken.

12 Claims, 2 Drawing Sheets

METHOD OF ALIGNING A FREELY CARRYING BEARING ASSEMBLY ON A CYLINDER IN A FIBER-MAKING MACHINE

BACKGROUND OF THE INVENTION

1. Field of the Invention

The present invention relates to machines for manufacturing a continuous layer of a fiber material having rotating rolls and, more particularly, to a method of providing an offset for a freely carrying bearing assembly on a roll in a machine for manufacturing a continuous layer of a fiber material.

2. Description of the Related Art

Machines for making fiber materials, such as paper, cardboard and the like, are well known. The fiber material is made in large continuous sheets known as webs. These machines utilize a plurality of rotating rolls or cylinders to move the fiber material web through the various stages of manufacture. The rotating cylinders perform a variety of functions. Generally, subset pluralities of cylinders are grouped into sections with each section performing a different task. An exemplary task in the making of the fiber material is drying in which one or many sections of dryer cylinders are utilized.

During the drying process, the fiber material web is directed through the series of drying cylinders that comprise the section. The drying cylinders are rotating rolls that can be heated to take the moisture away from the fiber material web as the fiber material web is caused to come into contact with an area of the cylinder. Generally these drying cylinders use steam supplied to the interior of the cylinder via attached tubing to heat the cylinder. The cylinder is made from a thermally conductive material such as an appropriate metal. As a result of such heating, the cylinders thermally expand in all directions, but especially along the longitudinal axis about which the roll rotates. The bearings at the ends of the cylinder are seated in housings that are firmly fixed to a support structure.

As the cylinders rotate at a high velocity to move the fiber material web along the fiber making machine, the ends of the cylinders are retained in bearings that must be designed to handle such speeds. Since the rotating cylinders are subject to axial and radial movement and perturbations, the bearings should be adapted to handle same. One type of bearing that can accommodate axial and radial movement is a freely carrying bearing, such as a so-called CARB (Continuous Alignment Roller Bearing) type bearings. Such CARB type bearings are manufactured by AB SKF of The SKF Group. When installing a freely carrying bearing on a cylinder, it is necessary to align the bearing assembly relative to the journal or cylinder axis (also the axis of rotation of the cylinder) in the X, Y and Z directions. Because of the precision at which the cylinder or roll needs to rotate, the more precise the alignment should be between the freely carrying bearings and the cylinder axis.

In an SKF brochure entitled "The CARB bearing—a better solution for the front side of drying cylinders," publication number 4410/1 E, copyright 1997 by SKF and specifically incorporated herein by reference, sets forth basic mounting instructions and target tolerances or offsets for installation of its CARB type freely carrying bearings. The mounting instructions include: 1) lubricating the mating surfaces (outer surface of journal and inner surface of inner race of bearing); 2) positioning the bearing assembly in the housing and on the shaft; 3) unloading the rollers of the bearing assembly; 4) driving the inner ring of the bearing assembly to a starting position on the journal by applying hydraulic pressure through a hydraulic ring nut; 5) driving the inner ring of the bearing assembly a required distance ($S_S \pm 5\%$) up the taper of the journal and waiting a few minutes; 6) bolting the bearing housing to the frame; 7) checking bearing housing alignment; 8) checking that axial displacement (of inner ring relative to outer ring) is within an acceptable range; and, if necessary, 9) adjusting the position of the bearing housing.

Because of the thermal expansion of the cylinder during operation, it is known to utilize the properties of a freely carrying bearing and axially offset the outer ring of the bearing assembly which is attached to the bearing housing relative to the inner ring of the bearing assembly which is affixed to the cylinder journal. Various offset values have been calculated by manufacturers for their particular freely carrying bearings, such as the SKF CARB, relative to thermal expansion of the cylinder.

What is needed in the art, however, is a method of aligning a freely carrying bearing assembly on a cylinder/cylinder journal in a fiber-making machine.

What is also needed is a method of determining and/or positioning an offset between an inner race and outer race of a freely carrying bearing assembly mounted onto a journal of a dryer cylinder in a paper-making machine.

SUMMARY OF THE INVENTION

The present invention is a method for aligning a freely carrying bearing assembly on a cylinder of a fiber-making machine. The freely carrying bearing assembly includes an inner race, an outer race, and a plurality of rollers therebetween.

The method comprises determining a desired outer race to inner race offset, determining an existing outer race to inner race offset relative to an alignment plate by utilizing measurements taken through the plurality of measurement slots in the alignment plate, and determining a correction outer race to inner race offset between the determined desired outer race to inner race offset and the determined existing outer race to inner race offset. The bearing is then aligned by axially positioning the seating structure according to any determined correction outer race to inner race offset.

The alignment plate includes an opening for the journal of the cylinder and a plurality of measurement slots radially extending from the opening. Preferably there are four slot positioned at 0°, 90°, 180°, and 270°. Each required determination according to the present method or measurement of axial length is preferably made from each slot.

BRIEF DESCRIPTION OF THE DRAWINGS

The above-mentioned and other features and advantages of this invention, and the manner of attaining them, will become more apparent and the invention will be better understood by reference to the following description of embodiment of the invention taken in conjunction with the accompanying drawings, wherein.

Corresponding reference characters indicate corresponding parts throughout the several views. The exemplification set out herein illustrates a preferred embodiment of the invention, and such exemplification is not to be construed as limiting the scope of the invention in any manner.

DETAILED DESCRIPTION OF THE INVENTION

Figure 1:
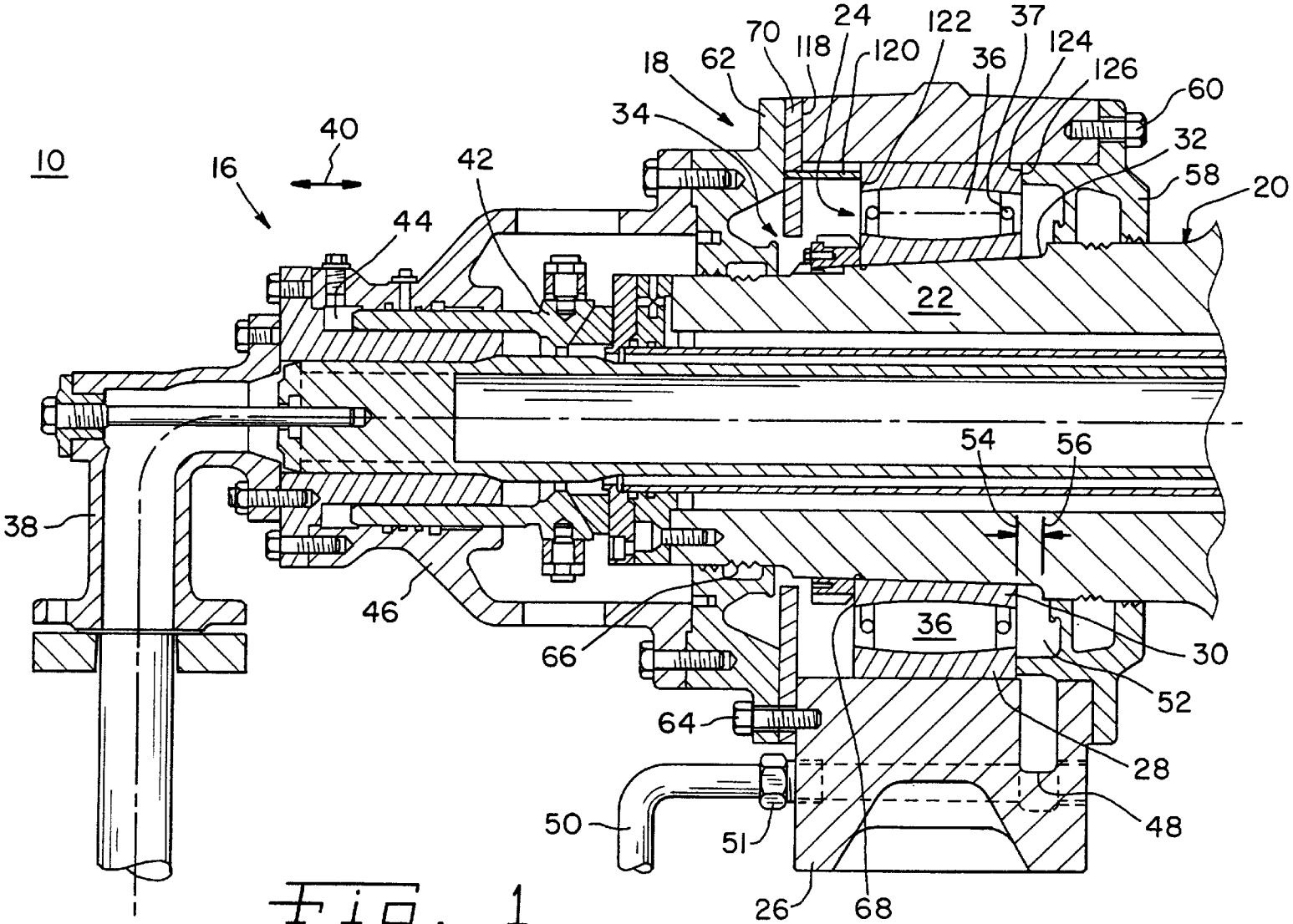
FIG. 1 is a fragmentary, side sectional view of one end of a dryer cylinder rotatably mounted in a freely carrying bearing assembly in accordance with the present invention and coupled to various supply/operating tubing.

Referring now to the drawings and, more particularly to FIG. 1, there is shown an apparatus that produces paper 10 and contains at least one roll in the form of a dryer cylinder 20. It should be understood that the present invention may apply to any sort of apparatus for the production of continuous layer material under use of a roll that can be heated in a controlled manner. FIG. 1 particularly shows, for purposes of illustration, the end of dryer cylinder 20 of an apparatus for the manufacture of paper 10 where there is an axle journal 22 rotatably extending through a bearing assembly 24 retained in seating structure or radial housing 26. Seating structure 26 is essentially radially disposed about bearing assembly 24 and forms, at least in part, bearing housing 18. Seating structure 26 is usually attached to a fixture such as a steel beam (not shown) that is part of the overall support structure (not shown) for dryer cylinder 20. Thus, seating structure 26 is effectively stationary. Inner cover 58 is removably attached to one side of seating structure 26 by a plurality of bolts, of which only one such bolt 60 is shown. Outer cover 62 is removably attached to the other side of seating structure 26 by a plurality of bolts, of which only one such bolt 64 is shown. Axle journal 22 axially extends through bores in inner cover 58 and outer cover 62.

Bearing assembly 24 is freely carrying, meaning that outer race or ring 28 of bearing assembly 24 is firmly connected to seating structure 26 and stationary, while inner race or ring 30 of bearing assembly 24 is radially adjacent outer surface 32 of journal 22 so as to be affixed thereto and rotate therewith. Disposed between outer race 28 and inner race 30 are a plurality of elongated, barrel-shaped rollers or bearings 36 held in place by retaining ring structure 37. Inner race 30 is affixed to journal 22 by coupling or locknut assembly 34. In this manner, inner race 30 not only rotates with journal 22, but may axially move when dryer cylinder 20 undergoes thermal expansion in the axial or "Z" direction, as indicated by double arrow 40. Longitudinal expansion of dryer cylinder 20 occurs inside of bearing assembly 24, where inner race 30 will move against outer race 28 if necessary, caused by a change in the radial clearance between inner race 30 and outer race 28 upon relative longitudinal movement between inner race 30 and outer race 28 and against rollers 36. The amount of axial or Z direction travel (displacement) tolerated by bearing assembly 24 (or the amount of axial tolerance or offset between inner race 30 and outer race 28) in one axial direction is indicated by the distance between lines 54 and 56. Of course, inner race 30 may be axially offset in the other axial direction). At the same time, regulator device 42 axially moves within annular chamber 44 disposed in web cone structure 46 to which steam pipe 38 is rigidly attached.

A rigid connection between steam supply pipe 38 and seating structure 26 is possible even with longitudinal expansion of dryer cylinder 20 or axle journal 22 due to thermal expansion, because bearing assembly 24, being a freely carrying bearing, accommodates such movement. Steam supply pipe 38 is coupled to a supply of steam (not shown) that is used to he at dryer cylinder 20 as is generally known in the art.

Seating structure 26 includes lubrication passages/bores 48 that provides communication between bearing ring area 52 and lubrication supply pipe 50 via pipe fitting 51. Lubrication supply pipe 50 is in fluid communication with a source of lubricant (not shown), typically oil. An oil return assembly that may include passages/bores in seating structure 26 would be in communication with bearing ring area 52 and an external sump, all of which are not shown but known in the art. What has thus been shown and described above is a freely carrying bearing assembly on a dryer cylinder in a fiber-making machine, the dryer cylinder coupled with various piping for supplying lubrication, steam and the like and for draining same.

Installation of freely carrying bearing assembly 24 is accomplished after an old bearing assembly is removed or as a new installation on a new cylinder. The procedure for mounting and aligning freely carrying bearing assembly 24 is the same for either situation. The following will assume an old bearing assembly is being removed.

In removing an existing bearing assembly, any steam supply (not shown) being supplied to steam pipe 38 or others is closed such that there is zero leakage into the dryer cylinder. Any bearing lube oil supply (not shown) is shut down. Steam pipe 38 is removed from web cone structure 46 of steam joint 16 while any condensate return line and/or siphon is disconnected. Steam joint 16 and any other related structure is removed. Thereafter, any lubrication supply being supplied to supply pipe 50 is shut off. Supply pipe 50 is removed and any other supply and return lines are disconnected. Bearing housing 18 is unbolted and cylinder 20 is raised and supported to maintain an elevated position. After cylinder 20 is elevated, bearing housing outer cover 62 is removed while bearing housing inner cover 58 is unbolted and slid axially inward towards cylinder 20 and away from seating structure 26. If the inner cover has an integral rope sheave assembly (not shown), also support the rope sheave assembly. Any remaining bearing housing is also removed. Bearing locknut assembly 34 is then removed and the old bearing assembly is removed from journal 22. It is preferable at this time to clean all parts, including journal 22. If at this point inner bearing housing cover 58 has been removed from cylinder 20, it should be slid back on.

Figure 2:
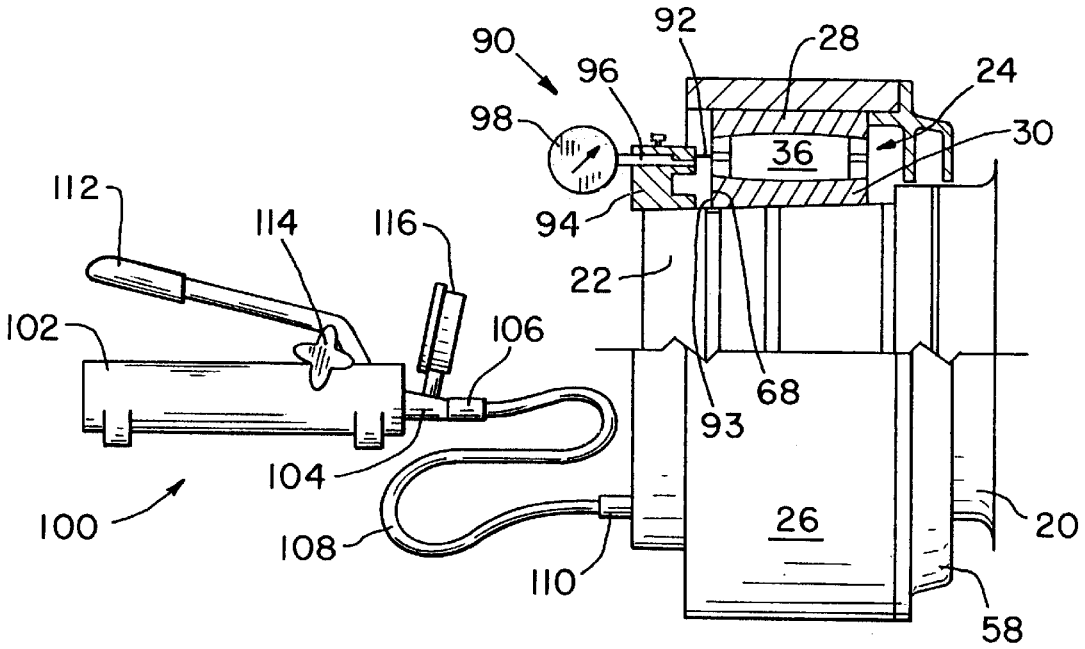
FIG. 2 is a fragmentary, side partial sectional view of one end of the dryer cylinder showing the freely carrying bearing assembly being mounted onto the journal of the dryer cylinder through use of a hydraulic nut assembly.

Installation of freely carrying bearing assembly 24 onto journal 22 should follow the manufacturer's instructions. However, with installation of an SKF CARB type freely carrying bearing assembly, reference should be made to the SKF brochure entitled "The CARB bearing—a better solution for the front side of drying cylinders," publication number 4410/1 E, copyright 1997 by SKF and specifically incorporated above by reference. In general, and with additional reference to FIG. 2, bearing assembly 24 and in particular, inner and outer races 30 and 28, are temperature stabilized with reference to the temperature of the journal 22 and/or cylinder 20. After inner and outer races 30 and 28 substantially reach the requisite temperature, inner race 30, journal 22, journal threads 66 (see FIG. 1), and outer face 68 of inner race 30 are lightly lubricated, preferably with SKF LHMF 300 thin oil type lubricant. Bearing assembly 24 is then slid axially onto journal 22.

Hydraulic nut assembly 90 is then installed onto journal 22 so as to axially abut outer face 68 of inner race 30. Hydraulic nut assembly 90 comprises annular bearing surface ring nut 92 that includes inner surface 93 which abuts face 68, and annular pressure ring 94 that includes pressure bore 96 in communication with gauge 98 such as an SKF HMV E type hydraulic nut. Hydraulic pressure is exerted axially against rings 94 and 92 by hydraulic pump assembly

100 to axially drive up bearing assembly 24 onto journal 22. Hydraulic pump assembly 100 includes hydraulic cylinder 102 having nozzle 104 in communication with hydraulic hose 108 via coupling 106 such as an SKF type hydraulic pump assembly. Hydraulic hose 108 is attached to coupling 110 which provides hydraulic fluid communication between hydraulic cylinder 102 and ring 94. Bearing assembly 24 is then driven axially up onto journal 22 (which is generally tapered) to a starting position as recommended by the manufacturer of the freely carrying bearing assembly. Indicator gauge 98 is then zeroed. Hydraulic pressure is then exerted against inner race 30 to drive inner race 30 to a final position again, as recommended by the manufacturer of the freely carrying bearing assembly. Hydraulic pressure is maintained against inner race 30 for again, a manufacturer's recommended time period, after which hydraulic nut assembly 90 and hydraulic pump assembly 100 are removed. At this point, bearing assembly 24 is essentially positioned and affixed onto journal 22.

Distance from the end of journal 22 to face 68 of inner race 30 is measured (the journal end to race face distance). Measurement is taken from four like radial places on the end of the journal to the face 68 of inner race 30 corresponding to 0°, 90°, 180°, and 270° and the valueslogged. The four journal end to race face values may be identified as a1, a2, a3, and a4, corresponding to radial places at 0°, 90°, 180°, and 270°. Locknut assembly 34 is thereafter installed.

Distance from the end of journal 22 to the face of locknut assembly 34 is measured (the journal end to locknut face distance). Measurement is again taken from four like radial places on the end of the journal to the face of locknut assembly 34 corresponding to 0°, 90°, 180°, and 270° and the values logged. The four journal end to locknut face values may be identified as b1, b2, b3, and b4, corresponding to 0°, 90°, 180°, and 270° respectively.

The journal end to locknut face values, b1, b2, b3, and b4, are subtracted from the respective journal end to race face values, a1, a2, a3, and a4, corresponding to its radial location, i.e. 0°, 90°, 180°, and 270° yielding locknut assembly thickness values ab1, ab2, ab3, and ab4. Locknut thickness values ab1, ab2, ab3, and ab4 correspond to radial locations, 0°, 90°180°, and 270° respectively. Bearing housing unit or seating structure 26 is installed and attached to a rigid frame member or the like usually by bolts, such that seating structure 26 may be shifted into position during alignment. Thereafter, inner bearing housing cover 58 is fastened to seating structure 26.

Figure 3:
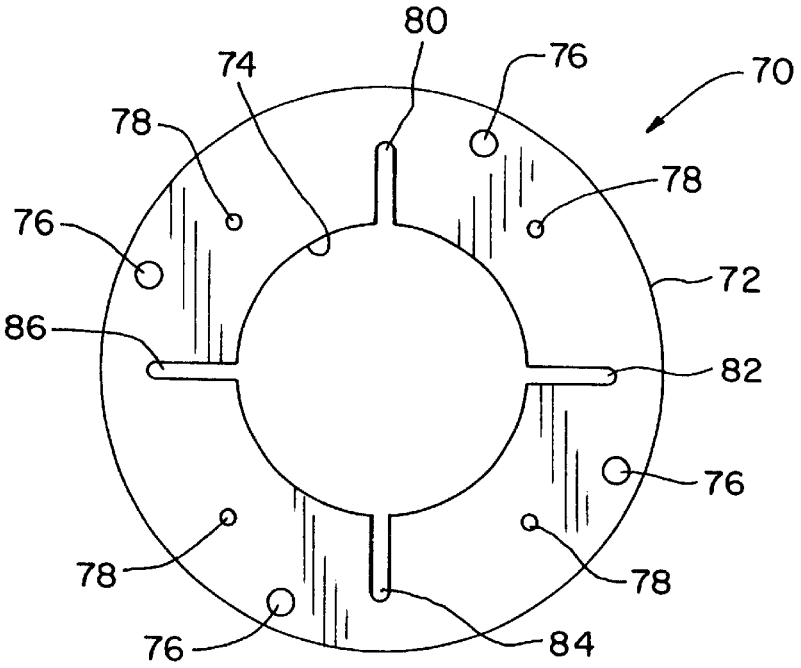
FIG. 3 is an enlarged front view of an alignment plate in accordance with the present invention.

With additional reference to FIG. 3, there is shown alignment or fixture plate 70 in accordance with an aspect of the present invention. Alignment plate 70 comprises a generally disc-shaped body 72 of a suitable material such as metal and of a suitable thickness. Disposed in the middle of body 72 is aperture 74 having four radially extending slots 80, 82, 84, and 86 corresponding in radial location to 0°, 90°, 180° , and 270°. Aperture 74 is sized to receive journal 22. Also disposed in body 72 are four radially spaced bores 76 each adapted to receive a bolt, screw or the like and four radially spaced bores 78 adapted to each receive a set screw of which one set screw 120 is shown (FIG. 1).

With reference to FIG. 1, alignment plate 70 is next mounted to seating structure 26 face 118 by attachment means in conjunction with bores 76. Set screws 120 are adjusted so as to axially abut and push against face 122 of outer race 28. This positions outer race 28 firmly, axially against cover 58 as face 124 of outer race 28 axially contacts face 126 of cover 58. After mounting of alignment plate 70, cylinder 20 is aligned to preferably be square and level to within ±0.005 inch. Shimming as well as axial movement of seating structure 26 may be necessary for alignment. Thereafter, seating structure 26 is firmly seated.

Next, the distance from the end of alignment plate 70 to locknut 34 is measured (the plate to locknut measurement) and the data points logged. Measurement is taken in four like radial places from alignment plate 70 to locknut 34 corresponding to 0°, 90°, 180°, and 270°. The four plate to locknut values may be identified as c1, c2, c3, and c4, and correspond to 0°, 90°, 180°,and 270° respectively. Opposing values are then compared, i.e. c1 (0°) to c3 (180°), and c2 (90°) to c4 (270°). If the difference between the compared values is too great, the bearing housing should be twisted to reduce the difference. Of course, reimbursement after adjustment would be necessary. Since journal 22 extends through journal opening 74 of alignment plate 70, slots 80, 82, 84, and 86 positioned at 0°, 90°, 180°, and 270° respectively, allows accurate measurement from a planar surface (i.e. alignment plate 70) to locknut 34. Thus, measurement of the plate to locknut distance is accomplished by taking the measure through the respective slot proximate journal opening 74.

After the plate to locknut distance is measured and logged, the distance from the end of alignment plate 70 to face 122 of outer race 28 is measured (the plate to outer race face) and the values logged. Measurement is taken in four like radial places from alignment plate 70 to face 122 corresponding to 0°, 90°, 180°, and 270°. The four plate to outer race face values may be identified as d1, d2, d3, and d4, and correspond to 0°, 90°, 180°, and 270° respectively. The temperature of cylinder 20 is thereafter recorded.

At this point the bearing housing offset in the Z or axial direction is set relative to journal 22. Journal 22 through thermal expansion may move relative to bearing housing 18. Since bearing housing 18 is coupled to outer race 28, and inner race 30 is affixed to journal 22, there is relative movement between outer race 28/bearing housing 18 and inner race 30/journal 22. Providing an initial offset or axial displacement of outer race28/bearing housing 18 towards pipe 38 allows there to be radial alignment during operation upon thermal expansion of cylinder 20. The offset is also the amount of axial displacement between inner and outer races 30 and 28. An initial offset of outer race 28 or bearing housing 18 relative to inner race 30 or journal 22, allows radial alignment of outer race 28 to inner race 30 because of the thermal expansion of cylinder 20 during operation. As cylinder 20 axially expands journal 22 axially moves thus also axially moving inner race 30. This axial offset value is determined from the temperature and dimensions of cylinder 20 with reference to the manufacturer's offset table. The offset value is logged.

The locknut thickness values ab1, ab2, ab3, and a W are then added to the alignment plate to outer race face values d1, d2, d3, and d4 respectively (i.e. ab1+d1, ab2+d2, ab3+d3, and ab4+d4) to yield intermediates values i1, i2, i3, and i4 again radially corresponding to 0°, 90°, 180°, and 270°. The distance from alignment plate 70 to locknut assembly 34 is measured at four like radial locations (0°, 90°, 180°, and 270°) to yield plate to locknut values e1, e2, e3, and e4 respectively. Next, intermediate values i1, i2, i3, and i4 are subtracted from plate to locknut values e1, e2, e3, and e4 respectively to yield the existing offset between inner race 30 and outer race 28 values eov1, eov2, eov3, and eov4 (e1–i1, e2–i2, e3–i3, and e4–i4) which are then subtracted from chart offset values determined from the manufacturer's charts to yield the needed offset values for the four radial points 0°, 90°, 180°, and 270°. Thereafter, housing 18 is positioned to achieve the correct axial orientation for the required offset of outer race 28 to inner race 28. Several measurements and repositioning may be necessary.

It is preferable at this time to obtain opposing measurements at the same four radial points to verify alignment. Outer cover 62 is thereafter attached to support structure 26 along with all steam supply and return piping, and lubrication supply and return piping. All other incidental hookups need to be made before starting.

While this invention has been described as having a preferred design, the present invention can be further modified within the spirit and scope of this disclosure. This application is therefore intended to cover any variations, uses, of adaptations of the invention using its general principles. Further, this application is intended to cover such departures from the present disclosure as come within known or customary practice in the art to which this invention pertains and which fall within the limits of the appended claims.

What is claimed is:

1. A method for aligning a freely carrying bearing assembly mounted on a dryer cylinder in paper-making machine, the freely carrying bearing assembly including an outer race, an inner race, and a plurality of rollers therebetween, the inner race coupled with a journal of the dryer cylinder by a locknut, the method comprising the steps of:

mounting a seating structure onto the outer race, the seating structure adapted to be fixedly mounted relative to the journal;

fixedly mounting the seating structure relative to the journal;

providing an alignment plate having an opening therein sized to receive the journal, a plurality of measurement slots radially extending from the opening and equally radially spaced thereabout, and a plurality of mounting bores;

attaching the alignment plate onto one side of the seating structure with use of the plurality of mounting bores, wherein the journal extends through the opening;

mounting an inner cover to another side of the seating structure;

maintaining the outer race against the inner cover;

determining a desired outer race to inner race offset;

determining an existing outer race to inner race offset relative to the alignment plate by utilizing measurements taken through the plurality of measurement slots;

determining a correction outer race to inner race offset between the determined desired outer race to inner race offset and the determined existing outer race to inner race offset; and axially aligning the seating structure according to any determined correction outer race to inner race offset.

2. The method of claim 1, wherein the step of determining an existing outer race to inner race offset comprises the steps of:

determining an axial length of the locknut;

determining an axial length from the alignment plate to the outer race;

adding the axial length of the locknut to the axial length of the alignment plate to the outer race;

determining an axial length of the alignment plate to the locknut; and subtracting the added axial lengths of the locknut and alignment plate to the outer race from the axial length of the alignment plate to the locknut.

3. The method of claim 2, wherein the step of determining the axial length of the locknut comprises the steps of:

measuring, before installation of the locknut, an axial distance from an end of the journal to the inner race;

measuring, after installation of the locknut, an axial distance from the end of the journal to the locknut; and subtracting the end of the journal to the locknut measurement from the end of the journal to the inner race measurement.

4. The method of claim 3, wherein each measurement comprises four distance values thereof taken at radial locations corresponding to 0°, 90°, 180°, and 270°.

5. The method of claim 1, wherein the step of determining a desired outer race to inner race offset comprises the steps of:

determining a temperature of the cylinder in a non-operating state; and correlating the determined temperature of the cylinder in the non-operating state with a bearing offset chart.

6. The method of claim 1, further comprising the step of:

mounting an outer c or to the seating structure.

7. A method of mounting a freely carrying bearing assembly on and relative to a journal of a dryer cylinder in a paper-making machine, the freely carrying bearing assembly having an inner race, an outer race, and a plurality of rollers disposed between the inner and outer races, the method comprising the steps of:

seating the freely carrying bearing assembly axially onto the journal;

installing a locknut assembly;

mounting a seating structure onto the outer race, the seating structure adapted to be fixedly mounted relative to the dryer cylinder;

mounting the seating structure relative to the dryer cylinder;

mounting an inner cover to the seating structure;

providing an alignment plate having an opening therein sized to receive the journal and a plurality of measurement slots radially extending from the opening;

mounting the alignment plate onto the seating structure wherein the journal extends through the opening;

maintaining the outer race against the inner cover;

leveling the seating structure;

squaring the seating structure relative to the journal;

determining a desired outer race to inner race offset;

determining an existing outer race to inner race offset relative to the alignment plate by utilizing measurements taken through the plurality of slots;

determining a correction outer race to inner race offset between the determined desired outer race to inner race offset and the determined existing outer race to inner race offset; and positioning axially the seating structure according to any determined correction outer race to inner race offset.

8. The method of claim 7, wherein the step of determining an existing outer race to inner race offset comprises the steps of:

determining an axial length of the locknut assembly;

determining an axial length from the alignment plate to the outer race;

adding the axial length of the locknut assembly to the axial length of the alignment plate to the outer race;

determining an axial length of the alignment plate to the locknut assembly; and subtracting the added axial lengths of the locknut assembly and alignment plate to the outer race from the axial length of the alignment plate to the locknut assembly.

9. The method of claim 8, wherein the step of determining the axial length of the locknut assembly comprises the steps of:

measuring, before installation of the locknut assembly, an axial distance from an end of the journal to the inner race;

measuring, after installation of the locknut assembly, an axial distance from the end of the journal to the locknut assembly; and subtracting the end of the journal to the locknut assembly measurement from the end of the journal to the inner race measurement.

10. The method of claim 9, wherein each measurement comprises four distance values thereof taken at radial locations corresponding to 0°, 90°, 180°, and 270°.

11. The method of claim 7, wherein the step of determining a desired outer race to inner race offset comprises the steps of:

determining a temperature of the cylinder in a non-operating state; and correlating the determined temperature of the cylinder in the non-operating state with a bearing offset chart.

12. The method of claim 7, further comprising the step of:

mounting an outer cover to the seating structure.

* * * * *

UNITED STATES PATENT AND TRADEMARK OFFICE

CERTIFICATE OF CORRECTION

PATENT NO. : 6,349,469 B1
DATED : February 26, 2002
INVENTOR(S) : Kenneth H. Larson It is certified that error appears in the above-identified patent and that said Letters Patent is hereby corrected as shown below:

Column 5,
Line 24, delete “valueslogged” and substitute -- values logged -- therefor.

Column 6,
Line 53, delete “a W” and substitute -- ab4 -- therefor.

Column 8,
Line 22, delete “c or” and substitute -- cover -- therefor.

Signed and Sealed this

Sixth Day of May, 2003

JAMES E. ROGAN
*Director of the United States Patent and Trademark Office*